US005329715A

United States Patent [19]

Po-Wen

[11] Patent Number: 5,329,715

[45] Date of Patent: Jul. 19, 1994

[54] CLOCK CONTROLLED SWINGING TOY WITH SOUND PRODUCING MEANS

[76] Inventor: Shih Po-Wen, 2nd Fl., 6-1, Sublane 1, Lane 437 Pateh Road, Sec. 2, Taipei, Taiwan

[21] Appl. No.: 926,647

[22] Filed: Aug. 10, 1992

[51] Int. Cl.[5] ..... G09F 19/08

[52] U.S. Cl. ..... 40/411; 40/414; 40/456; 446/299

[58] Field of Search ..... 40/411, 414, 430, 435, 40/456, 415; 446/299, 302

[56] References Cited

U.S. PATENT DOCUMENTS

| | | | |
|---|---|---|---|
| 1,090,207 | 3/1914 | Hardin | 40/415 |
| 1,431,892 | 10/1922 | Hadley | 446/302 X |
| 2,809,858 | 10/1957 | Marino | 40/456 X |
| 3,572,704 | 3/1971 | Glass et al. | 446/302 X |
| 3,636,655 | 1/1972 | Porter et al. | 446/302 |
| 3,675,362 | 7/1972 | de Gelder et al. | 40/415 X |
| 3,720,011 | 3/1973 | May | 40/456 |
| 4,209,174 | 6/1980 | Shiseki | 446/302 X |
| 4,212,007 | 7/1980 | Reyes et al. | 40/414 X |
| 4,670,867 | 6/1987 | Koike | 446/302 X |

*Primary Examiner*—Kenneth J. Dorner
*Assistant Examiner*—J. Bonifanti
*Attorney, Agent, or Firm*—Jones, Tullar & Cooper

[57] ABSTRACT

A swinging toy for swinging a doll includes a sound producing unit comprising of a platter, a record, a tone arm assembly. The sound producing unit is a buzzer and driven by a motor drive to produce sounds. A clock may be provided which is controlled by a control unit to turn on the motor drive once per hour. And an actuator comprising a chuck carried on a revolving rod connected to a crank through a link and driven by the platter of the sound producing unit through a transmission gear to swing the doll as the sound producing unit produces sounds is also provided.

2 Claims, 4 Drawing Sheets

CLOCK CONTROLLED SWINGING TOY WITH SOUND PRODUCING MEANS

BACKGROUND OF THE INVENTION

The present invention relates to a clock controlled swinging toy which is hourly controlled by a clock to swing and to produce sounds while swinging.

A variety of sound producing toys are known and widely accepted by children for the advantage of sound producing capability. For making a sound producing toy, an electronic sound producing system or a mechanical sound producing system may be used. An electronic sound producing system is generally comprised of a music IC controlled by a control circuit to produce sounds through a speaker. A mechanical sound producing system is generally comprised of a tone arm assembly moved along grooves on a record carried by a platter to produce sounds through a buzzer or speaker. In order to drive a sound producing toy to swing, an actuator is used. When an actuator is used in sound producing toy, two separate driving units are required for driving the actuator and the sound producing system. When two separate driving units are used, the structure of a toy becomes complicated.

SUMMARY OF THE INVENTION

One object of the present invention is to provide a swinging toy which produces sounds when swinging. Another object of the present invention is to provide a swinging toy which utilizes a single motor drive to simultaneously drive a sound producing unit to produce sounds and an actuator to swing, for example a doll. Still another object of the present invention is to provide a swinging toy which utilizes a clock to control a motor drive in driving a sound, producing unit to produce sounds and an actuator to, for example a doll. Still another object of the present invention is to provide a swinging toy which utilizes a control switch to turn on a motor drive directly or connect the motor drive to a clock permitting it to be controlled by the clock.

DETAILED DESCRIPTION OF THE PREFERRED EMBODIMENT

Figure 3:
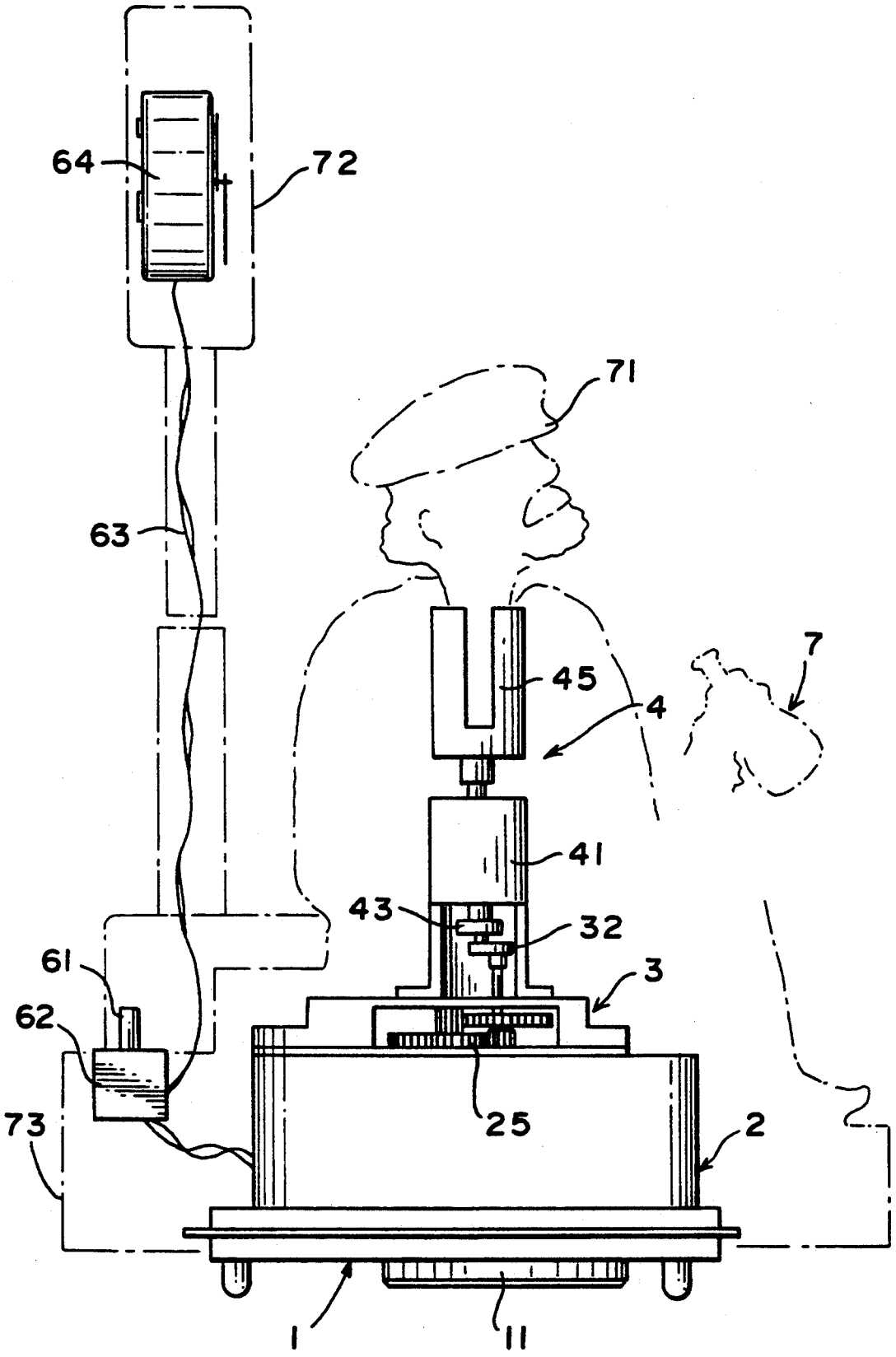
FIG. 3 is another cross section thereof taken in the longitudinal direction.

Referring to FIG. 3, a doll 7 is controlled to swing its head 71 and produce sounds by means of switching a switch lever 61. Alternatively, the doll 7 may be triggered by a clock 64 once per hour, to produce sounds and swing its head 71.

Figure 1:
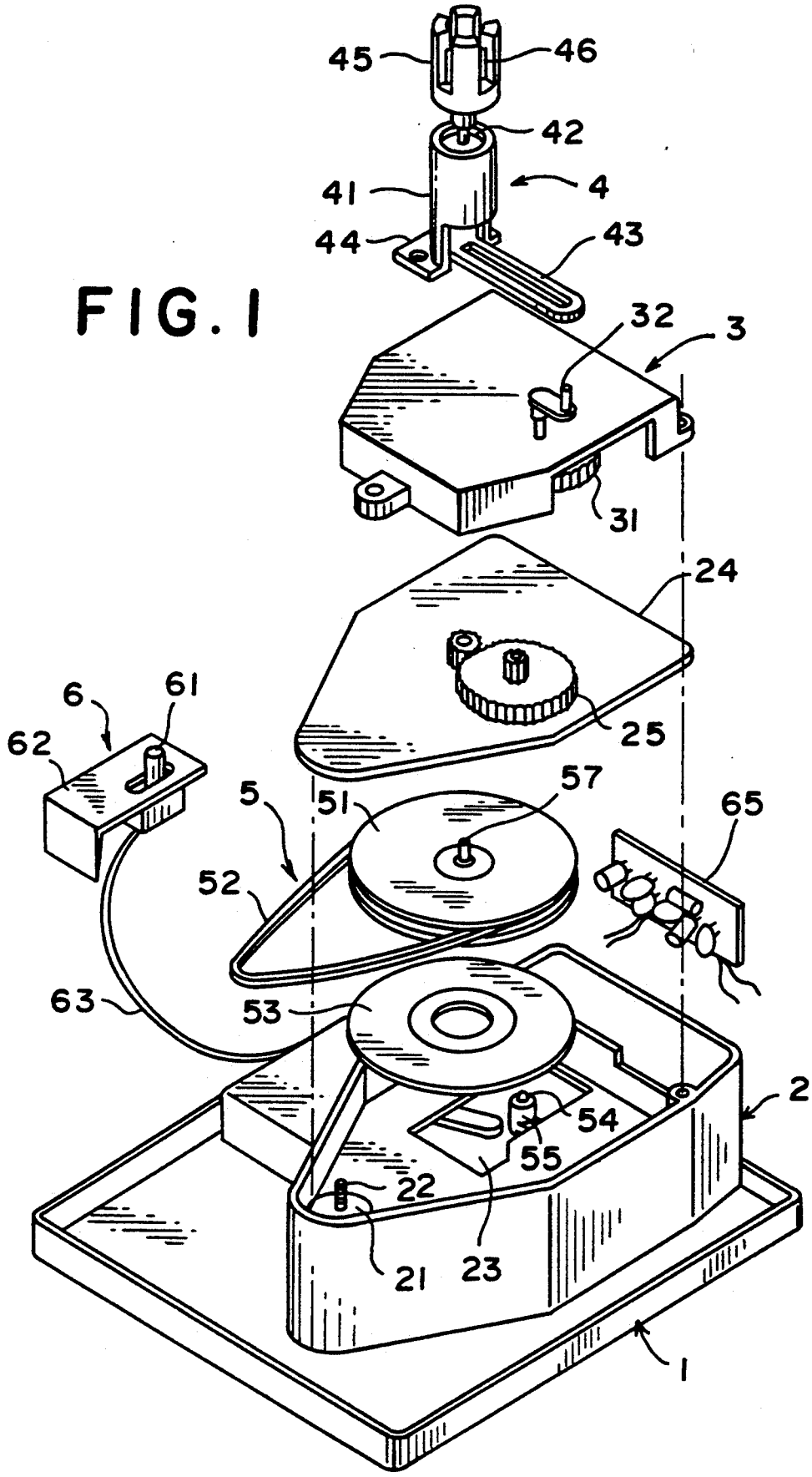
FIG. 1 is an exploded view of an embodiment of the present invention.
Figure 2:
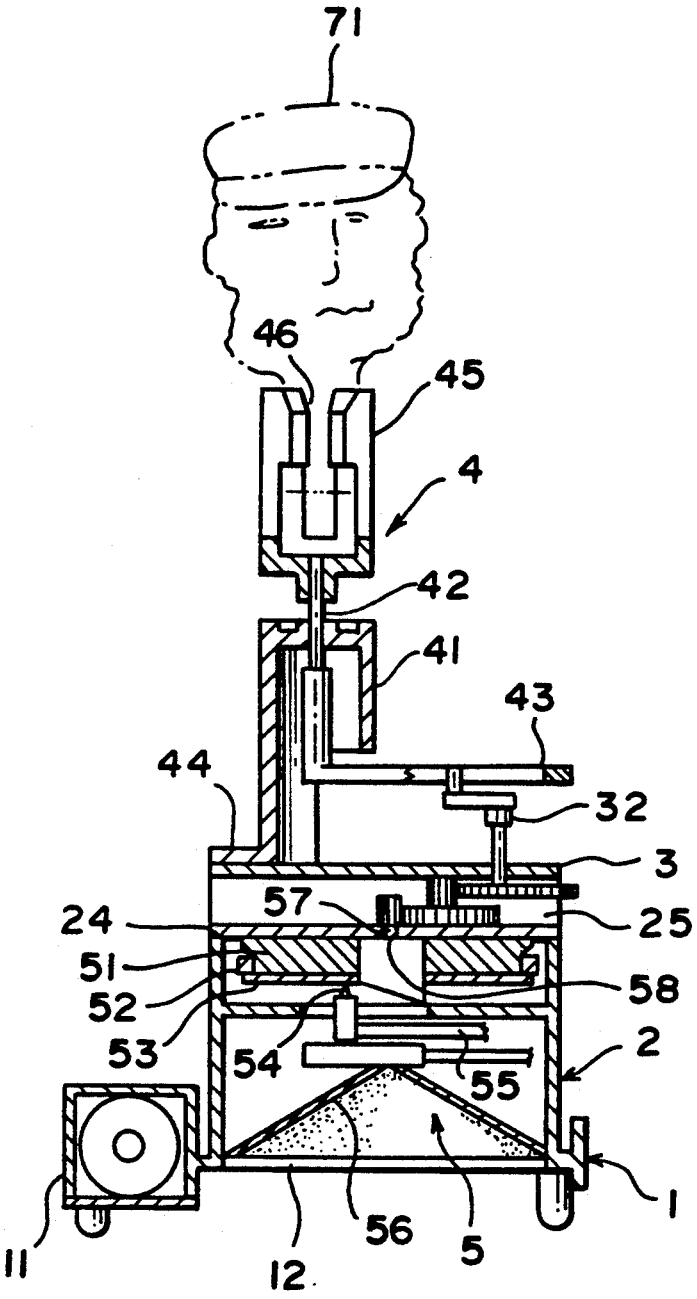
FIG. 2 is a cross section thereof taken in the transverse direction.

Referring to FIGS. 1, 2 and 3, the toy in accordance with the present invention is generally comprised of a base plate 1, a box 2, a top cover shell 3, an actuator 4, a sound producing unit 5, a control unit 6, and a swinging doll 7. The base plate 1 has a battery power supply 11 attached on the bottom. The box 2 is fastened to the base plate 1 on the top, having a mini-motor 21 connected to the battery power supply 11 for turning the sound producing unit 5 by a transmission shaft 22 via an endless belt 52. The sound producing unit 5 comprises a platter 51 driven by an endless belt 52, a mini-record 53 attached below the platter 51, a tone arm 55 projecting through opening 23 inside the box 2 below the minirecord 53, a cartridge 54 carried on the tone arm 55, a buzzer 56 fastened inside the box 2 below the tone arm 55. When triggered, the cartridge 54 is moved up and down according to the grooves on the minirecord 53, causing the buzzer 56 to produce sounds (this sound producing process can be achieved through regular techniques). The platter 51 has a spindle 57 which projects through an opening 58 is a cover board 24. The spindle 47 is and driven to rotate a reducing gear 25. As illustrated, the cover board 24 covers the box 2 which holds the sound producing unit 5 on the inside. The top cover shell 3 is fastened to the cover board 24 on the top to hold a driven gear 31. The driven gear 31 meshes with the reducing gear 25 and is driven to rotate a crank 32. Therefore, rotating the mini-motor 21 causes the crank 32 to rotate. The actuator 4 comprises a bottom mounting plate 44 fastened to the top cover shell 3 on the top at a suitable location, an upright tube 41 supported on the bottom mounting plate 44, a revolving rod 42 inserted inside the upright tube 41 for rotation relative thereto, a chuck 45 with jaws 46 carried on the revolving rod 42 for gripping the head 71 of the doll 7, and a link 43 connected between the revolving rod 42 and the crank 32. Therefore, rotating the crank 32 causes the revolving rod 42 to rotate the chuck 45, and therefore the head 71 of the doll 7 is simultaneously forced to swing. Because the crank 32 is driven to rotate by the spindle 57 of the platter 51, the head 71 of the doll 7 swings while the sound producing unit 5 produces sounds. The control unit 6 comprises of a switch lever 61 on a switch assembly 62, a circuit board 65 connected to the switch assembly 62, and a clock 64 fastened to a clock holder 72 and connected to the circuit board 65 by conductors 63.

Figure 4:
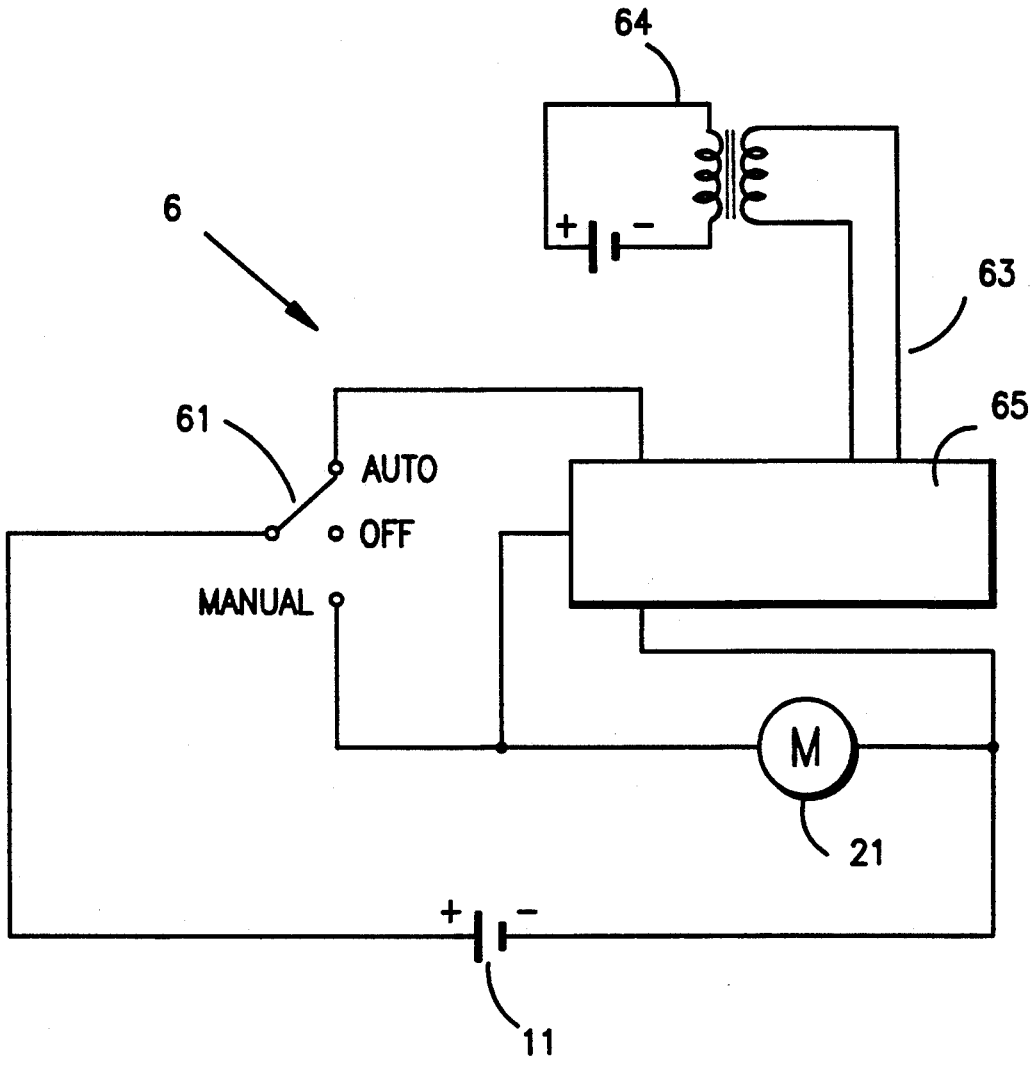
FIG. 4 is a control circuit block diagram according to the present invention.

Referring to FIG. 4, when the switch lever 61 is switched to the "AUTO" position, the clock 64 is connected to the circuit board 65 to turn on the minimotor 21 for 30 seconds once per hour; when the switch lever 61 is switched to the "OFF" position, the circuit is cut off and the toy does not work; and when the switch lever 61 is switched to the "MANUAL" position, the mini-motor 21 is electrically connected to turn on the sound producing unit 5 and the actuator 4 for continuous operation.

What is claimed is:

1. A swinging toy for swinging a doll, comprising: a base plate: a box supported above said base plate; a sound producing unit fastened in said box; a battery power supply; a motor drive connected to said battery power supply and controlled to turn on said sound producing unit; a control switch; a clock controlled by said control switch for turning on said motor drive; an actuator; and a transmission gear driven by said sound producing unit to rotate said actuator causing it to swing the doll, said sound producing unit comprising a platter driven by said motor drive through an endless belt to rotate a record, a cartridge carried on a tone arm and driven by said record to drive a buzzer causing it to produce sounds according to the grooves on said record, and said actuator comprising a bottom mounting plate fastened above said box, an upright tube supported on said bottom mounting plate, a rod mounted inside of said upright tube for rotation relative thereto, a chuck with jaws, said chuck being carried on said rod to grip the doll, a link connected between said rod, and a crank having an opposite end coupled to an output shaft on said transmission gear, said transmission gear having an input shaft coupled to a spindle on said platter of said sound producing unit.

2. A swinging toy for swinging a doll, comprising: a base plate: a box supported above said base plate; a sound producing unit fastened in said box; a battery power supply; a motor drive connected to said battery power supply and controlled to turn on said sound producing unit; control means for turning on said motor drive; an actuator; and a transmission gear driven by said sound producing unit to rotate said actuator causing it to swing the doll, said sound producing unit comprising a platter driven by said motor drive through an endless belt to rotate a record, a cartridge carried on a tone arm and driven by said record to drive a buzzer causing it to produce sounds according to the grooves on said record, and said actuator comprising a bottom mounting plate fastened above said box, an upright tube supported on said bottom mounting plate, a rod mounted inside of said upright tube for rotation relative thereto, a chuck with jaws, said chuck being carried on said rod to grip the doll, a link connected between said rod, and a crank having an opposite end coupled to an output shaft on said transmission gear, said transmission gear having an input shaft coupled to a spindle on said platter of said sound producing unit.

* * * * *